United States Patent [19]

Gassen et al.

[11] Patent Number: 4,756,668

[45] Date of Patent: Jul. 12, 1988

[54] AIR INTAKE COVER FOR A BLOWER VACUUM APPARATUS

[75] Inventors: James Gassen, Charlotte, N.C.; John E. Reed, Brookhaven, Mich.

[73] Assignee: Textron Inc., Providence, R.I.

[21] Appl. No.: 76,768

[22] Filed: Jul. 23, 1987

[51] Int. Cl.[4] ..... F04D 29/70

[52] U.S. Cl. ..... 416/247 R; 415/121 G; 415/204; 15/405; 15/422

[58] Field of Search ..... 415/203, 204, 206, 219 R, 415/121 G; 416/247 R; 15/405, 422

[56] References Cited

U.S. PATENT DOCUMENTS

| | | | |
|---|---|---|---|
| 2,242,616 | 5/1941 | O'Brien | 415/204 |
| 2,884,863 | 5/1959 | Hartmann | 415/204 |
| 4,325,163 | 4/1982 | Mattson et al. | 15/405 |
| 4,356,535 | 10/1982 | Chu | 416/247 R |
| 4,404,706 | 9/1983 | Loyd | 15/405 |
| 4,494,908 | 1/1985 | Hopfensperger | 415/206 |
| 4,634,346 | 1/1987 | Cameron et al. | 416/247 R |
| 4,644,606 | 2/1987 | Luerken et al. | 15/405 |

*Primary Examiner*—Robert E. Garrett
*Assistant Examiner*—John T. Kwon
*Attorney, Agent, or Firm*—Abraham Ogman

[57] ABSTRACT

The invention is directed to a protective cover for the air intake opening in a blower-vacuum apparatus. The cover contains opening defined in the cover having a large cross sectional area relative to the area of the air intake opening. The openings in the cover are in the vertical wall of the cover to force the air to enter the apparatus radially.

2 Claims, 1 Drawing Sheet

*Fig.1.*
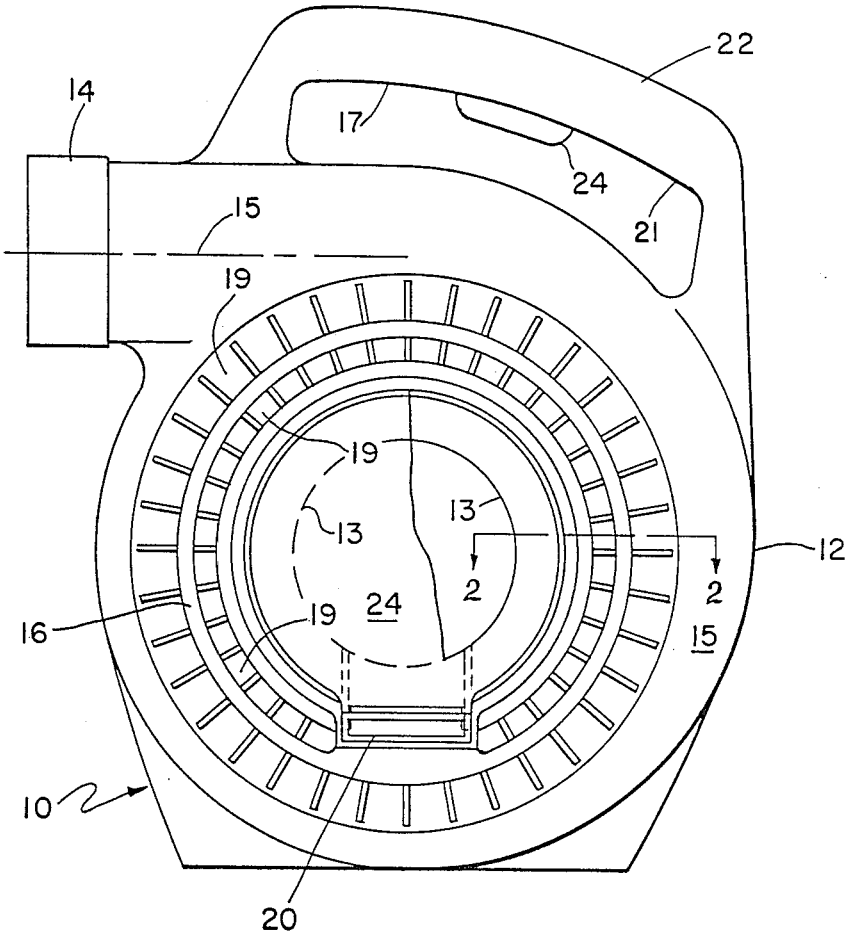
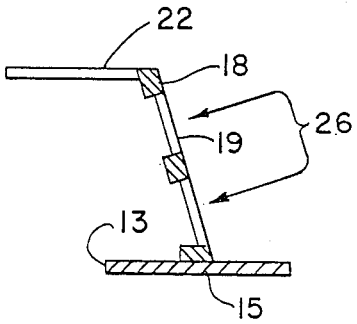
*Fig.2.*

AIR INTAKE COVER FOR A BLOWER VACUUM APPARATUS

BACKGROUND

The invention relates to blower-vacuum apparatus and more particularly an improved air intake cover.

A blower- vacuum apparatus ingests large volumes of air through an air intake opening in the housing of the apparatus.

A serious problem associated with such prior devices is that there is a tendency for clothing and small objects to be ingested into the air intake opening. When operating as a blower the apparatus is held alongside the hip and thigh region of the body. When it is close to the body clothing and other objects such as loose cloth are drawn into the air intake opening.

Problems are created by this tendency because there is (i) a small opening and the suction force per unit area is large, and (ii) the protective cover for the air intake opening is generally a grate providing openings in the vicinity of clothing through which the clothing is attracted.

Such prior art devices are displayed in U.S. Pat. Nos. 4,325,163 and 4,644,606 to Mattson and Luerken respectively.

OBJECTS

It is an object of the invention to provide a protective cover for an air intake opening in a blower-vacuum apparatus which avoids the limitations and disadvantages of such prior devices.

It is yet another object of the invention to provide a protective cover for an air intake opening of a blower-vacuum apparatus which has a large cross sectional area through which air enters the apparatus so that the pressure per unit area in the vicinity of the cover is substantially reduced.

It is yet another object of the invention to provide a protective cover for an air intake opening of a blower-vacuum apparatus in which all of the air entering the apparatus enters substantially radially.

SUMMARY OF THE INVENTION

In accordance with the invention a protective cover for the air intake opening of a blower-vacuum apparatus comprises a hollow cylindrical or conical wall overlying the air intake opening and having a multiplicity of openings through the wall in communication with the air intake opening. The remote end of the wall is closed by an end member which is preferably a flat plate. The plate has defined in it a hinged opening through which a tube can be inserted for drawing a vacuum.

DESCRIPTION OF THE FIGURES

FIG. 1 shows a protective cover embodying the principles of the present invention; and FIG. 2 is a section taken along line 2—2 of FIG. 1.

DESCRIPTION OF THE INVENTION

Referring to FIG. 1 there is shown a blower-vacuum apparatus 10 having a volute housing 12 and an air intake opening 13 shown partially in dottd outline and partially structurally at the right of center in the broken out section. The air intake opening 13 is defined in FIG. 2 by a central opening in the front face 15 of the housing 12.

Seated on the front face 15 over the air intake opening 13 is a protective cover 16. The cover contains a conical wall 18 through which are defined a multitude of openings 19 in direct communiction with the air intake opening 13. The wall may be cylindrical or contain a plurality of flat vertical surfaces. It is really not critical.

Defined in the remote end of the wall 18 of the protective cover 16 is an opening 22 which in turn includes a hinged closure 24. The hinge is identified by the symbol 20. The closure 24 enables a tube to be inserted into the air intake opening for vacuuming up leaves and other debris.

The critical factor relates to the ratio of the total area of the openings relative to the cross sectional area of the air intake opening. Blower-vacuum apparatus move large volumes of air.

For example a typical unit operating at 6000 rpm will move 334 cubic feet per minute while at 7200 rpm 400 cubic feet per minute is processed. The conventional air intake opening is small openings. To move these large volumes the internal fan must develop relatively high suction pressures. In the past these pressures were able to suck into the unit such things as clothing or a loose cloth which may have carried by the operator near the air intake opening. It was not possible to lean a hand held apparatus against the body.

The invention proposes to reduce the suction pressure where the air enters the apparatus by providing an enlarged opening in the protective cover. Further the enlarged opening forces the air to enter radially to avoid sucking in objects that may be axially adjacent to air intake opening and cover.

In addition improved sound control is provided by shielding the line of sight propagated noise.

Preferably the ratio of total area of openings 19 and the cross sectional are of the air intake opening shall be at least 1.5. For more powerful apparatus operating at high vacuum pressures the ratio should be between 2 and 3.

In addition the remote end of the wall 18 shall be closed to force the air to enter radially through the openings 19 as shown by the arrows 26 in FIG. 2

It will of course be understood that various changes may be made in the form, details arrangement and proportions of the various parts without departing from the scope of the invention.

What is claimed is:

1. A protective cover for an air intake opening of blower-vacuum apparatus comprising:

A hollow wall member having a closed end and an open end, the open end for being positioned over the air intake opening, the hollow wall member having defined therein a plurality of openings for the passage of air radially into the interior of the protective cover, the total crossectional area of the openings in the wall member exceeds the crosssectional area of the air intake opening by 1.5 to 3 times for reducing the presssure per unit area of the air entering the cover.

2. A protective cover as defined in claim 1 wherein the wall member is conical.

* * * * *